US008973555B2

(12) United States Patent
Kurita et al.

(10) Patent No.: US 8,973,555 B2
(45) Date of Patent: Mar. 10, 2015

(54) AIR-INTAKE CONTROL APPARATUS OF INTERNAL COMBUSTION ENGINE

(75) Inventors: Kazuhisa Kurita, Tokyo (JP); Chiaki Sugano, Tokyo (JP); Teruhiko Moriguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 306 days.

(21) Appl. No.: 13/584,144

(22) Filed: Aug. 13, 2012

(65) Prior Publication Data

US 2013/0247868 A1 Sep. 26, 2013

(30) Foreign Application Priority Data

Mar. 23, 2012 (JP) ..... 2012-066732

(51) Int. Cl.
*F02D 11/10* (2006.01)
*F02D 9/10* (2006.01)

(52) U.S. Cl.
CPC ..... *F02D 11/10* (2013.01); *F02D 9/1065* (2013.01)
USPC ..... 123/337

(58) Field of Classification Search
CPC ..... F02D 11/10; F02D 9/109; F02D 9/1065
USPC ..... 123/337
See application file for complete search history.

(56) References Cited

U.S. PATENT DOCUMENTS 8,464,688 B2 * 6/2013 Kurita et al. ..... 123/337
8,671,910 B2 * 3/2014 Kurita et al. ..... 123/337

FOREIGN PATENT DOCUMENTS

JP 5194104 U 1/1975
JP 04-056724 A 2/1992
JP 4056724 B2 7/2002
JP 2008082648 A 4/2008
JP 2010144541 A 7/2010

OTHER PUBLICATIONS

Japanese Office Action issued on Feb. 5, 2013 in Japanese Patent Application No. 2012-066732.

* cited by examiner

*Primary Examiner* — Hai Huynh
(74) *Attorney, Agent, or Firm* — Sughrue Mion, PLLC

(57) ABSTRACT

An air-intake control apparatus of an internal combustion engine formed by attaching a flange portion provided to an end portion of a drive motor to a cylindrical hole portion. A throttle body has at least one positioning projection (or recess) provided to an inner wall of the cylindrical hole portion. The drive motor complementarily has at least one positioning recess (or projection) provided to the flange portion at a position corresponding to the positioning projection (or recess). The drive motor is attached to the cylindrical hole portion while the positioning recess (or projection) abuts on the positioning projection (or recess) in such a manner that a center distance between a motor shaft and a throttle shaft takes a predetermined value. Hence, not only attachment workability but also attachment accuracy of the drive motor can be enhanced. The air-intake control device therefore has higher product reliability.

7 Claims, 5 Drawing Sheets

AIR-INTAKE CONTROL APPARATUS OF INTERNAL COMBUSTION ENGINE

BACKGROUND OF THE INVENTION

1. Field of the Invention

The present invention relates to an air-intake control apparatus of an internal combustion engine, and more particularly, to an air-intake control apparatus equipped with a drive motor that controls an opening degree of a throttle valve.

2. Related Art

There is an air-intake control apparatus of this type in the related art configured in such a manner that a drive motor is attached to a throttle body that defines an air intake channel and an opening degree of a throttle valve is controlled by turning a throttle shaft to an arbitrary angle via a gear coupled to a motor shaft as is described, for example, Patent Document 1.

In the disclosed air-intake control apparatus, the throttle body is provided with a cylindrical hole portion for drive motor attachment and an arc-like protrusion at a position opposing the cylindrical hole portion. Meanwhile, a periphery of a flange of the drive motor is of a shape conforming to an inner wall of the cylindrical hole portion and the arc-like protrusion of the throttle body. Hence, by putting the throttle body and the drive motor together using these hole portion and protrusion and the conforming shape as a positioning region, rattling of the drive motor in a radial direction is suppressed.

PATENT DOCUMENT

Patent Document 1: Japanese Patent No. 4056724

The air-intake control apparatus disclosed in Patent Document 1, however, requires a certain amount of clearance between an inner surface of the cylindrical hole portion for drive motor attachment and a drive motor attachment region formed of the arc-like protrusion at the position opposing the cylindrical hole portion of the throttle body and the periphery of the motor flange in terms of workability during attachment of the drive motor. This requirement raises a problem that it becomes extremely difficult to secure attachment accuracy of the drive motor within a range of acceptable variation of a center distance between gears. Also, because both of the throttle body and the drive motor are used for positioning, dimension settings with a high degree of accuracy are required for a wide region. Accordingly, there arises another problem that individual components become more expensive.

Also, in order to achieve a center distance with a high degree of accuracy by suppressing the clearance, press-fitting may be adopted for the positioning region between the drive motor and the throttle body. This countermeasure, however, raises still another problem that the configuration enabling the press-fitting requires a further higher degree of accuracy for respective components than is required for the dimension settings to secure the clearance described as above.

Further, because a press-fitting process becomes necessary, there arises still another problem that attachment workability becomes poor.

Also, as is disclosed in Patent Document 1, in an air-intake control apparatus in the related art having no positioning mechanism in the drive motor and the throttle body, it is necessary to attach the drive motor to the throttle body while a center distance between the motor shaft and the throttle shaft is adjusted using a jig or facilities. Accordingly, this air-intake control apparatus has a problem that attachment workability is poor.

SUMMARY OF THE INVENTION

The invention is devised to solve the problems as discussed above and has an object to obtain an air-intake control apparatus capable of enhancing attachment workability of a drive motor by simple component configuration and means and achieving higher product reliability by enhancing a degree of drive motor attachment accuracy.

An air-intake control apparatus of an internal combustion engine according to an aspect of the invention includes: a throttle body defining an air intake channel for an internal combustion engine and having within a throttle shaft supported in a rotatable manner, a throttle gear attached to the throttle shaft, and a motor shaft provided with a pinion gear meshed with the throttle gear, and in which a drive motor that turns the throttle shaft to an arbitrary angle via the pinion gear and the throttle gear is stored. The drive motor is housed in a cylindrical hole portion provided to the throttle body. A flange portion provided to an end portion of the drive motor is attached to the cylindrical hole portion. The throttle body has at least one positioning projection (or recess) provided to an inner wall of the cylindrical hole portion. The drive motor complementarily has at least one positioning recess (or projection) provided to the flange portion at a position corresponding to the positioning projection (or recess). The drive motor is attached to the cylindrical hole portion while the positioning recess (or projection) abuts on the positioning projection (or recess) in such a manner that a center distance between the motor shaft and the throttle shaft takes a predetermined value.

According to the air-intake control apparatus of an internal combustion engine configured as above, by providing the positioning recess and projection to the drive motor and the throttle body only on one sides and by merely allowing the positioning recess and projection to abut on each other by pressing the drive motor from sideways using an attachment jig, it becomes possible to attach the drive motor to the throttle body easily without having to adjust a center distance between the motor shaft and the throttle shaft. Consequently, it becomes possible to enhance attachment workability of the drive motor.

Also, with the air-intake control apparatus of an internal combustion engine configured as above, the drive motor is attached to the throttle body by pressing the positioning recess and projection of the drive motor and the throttle body against each other. Hence, there is no need to provide a clearance between the drive motor and the throttle body. Consequently, it becomes possible to set a center distance between the motor shaft and the throttle shaft with a high degree of accuracy.

Further, with the air-intake control apparatus of an internal combustion engine configured as above, it is only necessary to finish a limited region on one sides of the drive motor and the throttle body with a high degree of accuracy. Hence, not only can a processing time be shortened markedly, but also dimensions can be controlled easily.

The foregoing and other objects features, aspects, and advantages of the present invention will become more apparent from the following detailed description of the present invention when taken in conjunction with the accompanying drawings.

DESCRIPTION OF THE PREFERRED EMBODIMENTS

Figure 1:
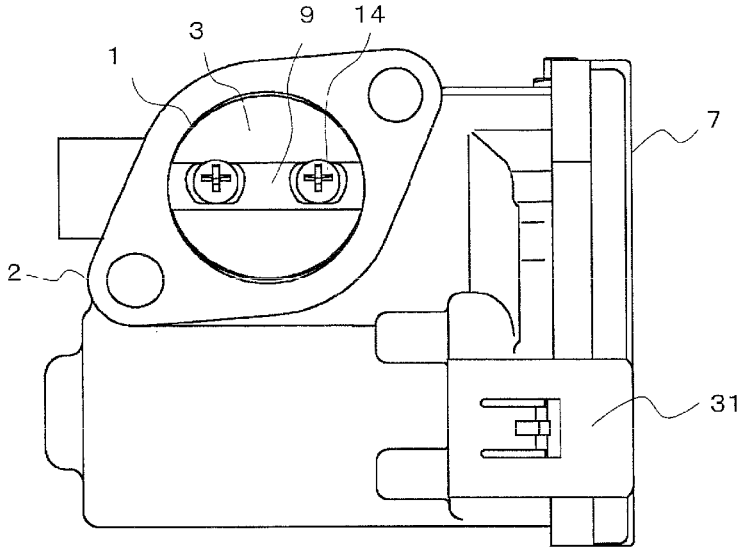
FIG. 1 is a front view of an air-intake control apparatus of an internal combustion engine according to a first embodiment of the invention.

Hereinafter, embodiments of the invention will be described with reference to the drawings. Descriptions will be given by labeling same or equivalent members and portions with same reference numerals in the respective drawings.

First Embodiment

Figure 2:
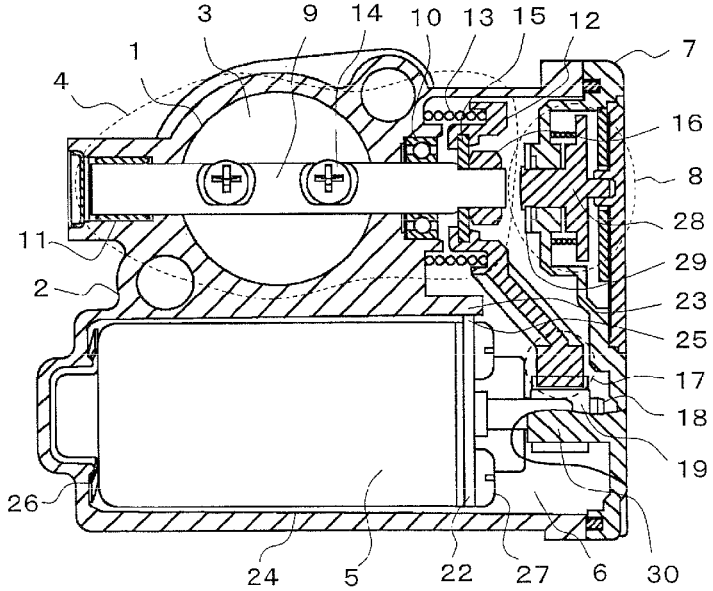
FIG. 2 is a sectional front view of FIG. 1.
Figure 3:
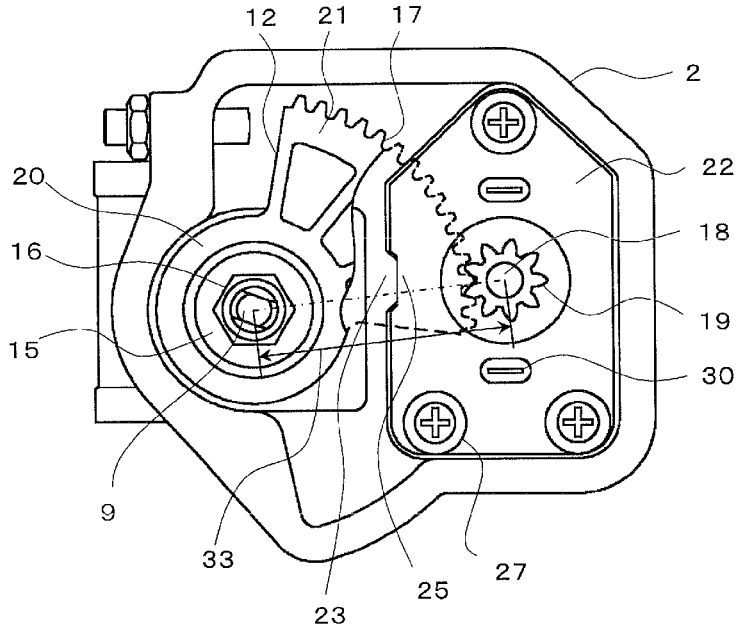
FIG. 3 is a side view of FIG. 1 on a side of a drive portion in a state where a cover is removed.
Figure 4:
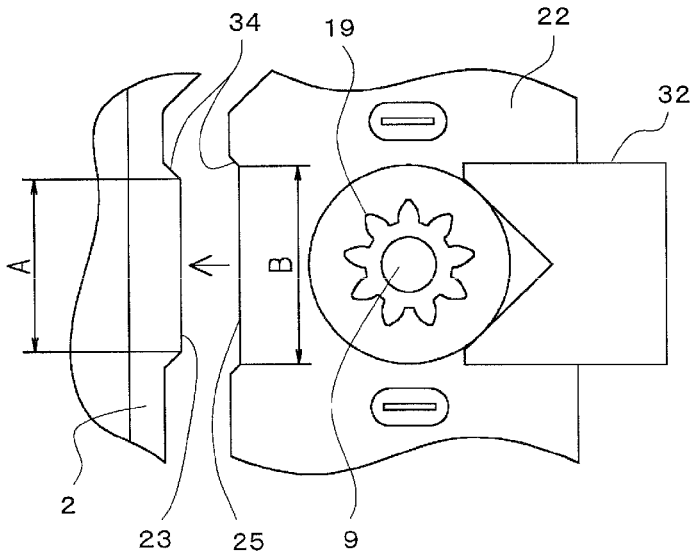
FIG. 4 is a view used to describe positioning projection and recess of a throttle body and a drive motor, respectively, in the first embodiment.

FIG. 1 is a front view of a first embodiment of an air-intake control apparatus of the invention. FIG. 2 is a sectional front view of the air-intake control apparatus of FIG. 1. FIG. 3 is a side view on a side of a drive portion in a state where a cover is removed in the first embodiment. FIG. 4 is a view used to describe positioning projection and recess of a throttle body and a drive motor, respectively, of the first embodiment.

Referring to FIG. 1 through FIG. 4, a throttle body 2 defining an air intake channel 1 for an internal combustion engine is manufactured, for example, by subjecting aluminum to die cast molding.

The throttle body 2 has a throttle valve forming portion 4 supporting a throttle valve 3 in an openable and closable manner and a drive chamber portion 6 in which a drive motor 5 driving the throttle valve 3 and a power transmission mechanism are housed. The throttle body 2 is formed so that only apart (right end in the drawings) is open and this opening portion is covered with a cover 7.

The cover 7 is formed, for example, by resin molding and a rotation angle detection device 8 that detects a rotation angle of the throttle valve 3 is built therein.

The air intake channel 1 has a circular shape in cross section and extends perpendicularly to sheet surfaces of FIGS. 1 and 2.

The throttle valve forming portion 4 has a throttle shaft 9, first and second bearings 10 and 11 that support the throttle shaft 9 at both ends, the throttle valve 3 of a butterfly shape and opening and closing the air intake channel 1 with rotations of the throttle shaft 9, and a return coil spring 13 provided between a throttle gear 12 and the throttle body 2 and storing energy with rotations of the throttle shaft 9 and returning the throttle shaft 9 to an original position when a rotational force ceases.

The throttle shaft 9 is disposed so that a shaft line thereof intersects at right angles with the air intake channel 1. The throttle shaft 9 is supported on the first and second bearings 10 and 11 in a rotatable manner about the shaft line.

The first bearing 10 is formed of a ball bearing disposed at one end (right end in the drawings) of the throttle shaft 9. The second bearing 11 is formed of a metal bearing disposed at the other end (left end in the drawings) of the throttle shaft 9.

The throttle valve 3 is formed of a circular plate of substantially the same size as the air intake channel 1 and disposed so as to traverse the air intake channel 1. The throttle valve 3 is firmly attached to the throttle shaft 9 with screws 14 and rotates together with the throttle shaft 9.

A valve opening degree of the throttle valve 3 varies with a rotation position of the throttle valve 3 so that an air-intake amount to the internal combustion engine is controlled.

The throttle gear 12 provided in an axial end portion (right end in FIG. 2) of the throttle shaft 9 is a ring-like resin mold body provided so that an insert body 15 fixed to the throttle shaft 9 is fit therein. The throttle gear 12 is fixed to the throttle shaft 9 with a nut 16 so as to rotate integrally with the throttle shaft 9 via the insert body 15.

A gear tooth plane portion 17 of the throttle gear 12 is meshed with a pinion gear 19 provided to a motor shaft 18 of the drive motor 5, so that a drive force of the drive motor 5 is transmitted at a reduced speed.

Further, the throttle gear 12 is formed of a ring-like supporting portion 20 used to fit the insert body 15 into the throttle shaft 9 and a fan-like portion 21 having the gear tooth plane portion 17. The fan-like portion 21 is offset in an axial direction of the throttle shaft 9 with respect to the supporting portion 20 attached to the throttle shaft 9 through the insert body 15 (see FIGS. 2 and 3).

The drive motor 5 is fixed at a bottom of the throttle body 2 in such a manner that the motor shaft 18 thereof becomes parallel to the throttle shaft 9. When the drive motor 5 is driven according to a command from the outside, the drive motor 5 drives the throttle shaft 9 via a power transmission mechanism formed of the pinion gear 19, the throttle gear 12, and the like to increase a valve opening degree of the throttle valve 3 against the return coil spring 13.

After the driving by the drive motor 5 ceases, the throttle valve 3 is returned in a closing direction by the return coil spring 13.

A cylindrical hole portion 24 is provided to the drive chamber portion 6 of the throttle body 2 and one positioning projection 23 is provided to the cylindrical hole portion 24 in one surface on the side of the throttle shaft 9. Meanwhile, a flange portion 22 is provided to the drive motor 5 and one positioning recess 25 is provided to the flange portion 22 in one surface on the side of the throttle shaft 9 at a position corresponding to the positioning projection 23. Also, the drive motor 5 is attached to the throttle body 2 while these positioning projection and recess 23 and 25 are in contact with each other (see FIG. 4).

In addition, a blade spring 26 (for example, a corrugated washer) is attached between a bottom portion of the drive motor 5 and a bottom portion of the cylindrical hole portion 24 of the throttle body 2. The drive motor 5 is attached to the throttle body 2 with three fastening screws 27 while the blade spring 26 is in a compressed state.

The rotation angle detection device 8 is formed integrally with the cover 7 and has a rotor 28 supported on the cover 7 in a rotatable manner. The rotation angle detection device 8 is disposed in such a manner that a shaft center of the rotor 28 coincides with a shaft center of the throttle shaft 9 when the cover 7 is attached to the throttle body 2.

Also, a lever 29 is fixed to the rotor 28 in an axial end portion opposing the throttle shaft 9. The lever 29 fits to a part of the fan-like portion 21 of the throttle gear 12 and rotates by following the throttle shaft 9.

The cover 7 is provided with a motor terminal portion 30 in a protrusion shape that electrically connects the drive motor 5. Further, the cover 7 is provided with a connector 31 to electrically connect the drive motor 5 and the rotation angle detection device 8 to an outside source.

As has been described, according to the air-intake control apparatus of the first embodiment, the positioning recess 25 is provided to one surface of the flange portion 22 of the drive motor 5 whereas the positioning projection 23 is provided to one surface of the cylindrical hole portion 24 provided to the drive chamber portion 6 of the throttle body 2. Then, by attaching the drive motor 5 to the throttle body 2 with the motor fastening screws 27 while the positioning recess 25 and projection 23 are maintained in an abutment state by pressing the drive motor 5 from sideways with the attachment jig 32, the drive motor 5 is attached to the cylindrical hole portion 24 in such a manner that the center distance 33 between the motor shaft 18 and the throttle shaft 9 takes a predetermined value. Hence, because the drive motor 5 can be attached to the throttle body 2 easily without having to adjust the center distance 33, it becomes possible to enhance attachment workability of the drive motor 5.

Also, the drive motor 5 is attached to the throttle body 2 by pressing the positioning recess 25 of the former and the positioning projection 23 of the latter against each other. Hence, there is no need to provide a clearance between the drive motor 5 and the throttle body 2 and a tolerance of the center distance 33 does not have to take the clearance into consideration. Accordingly, it becomes possible to attach the drive motor 5 to the throttle body 2 while achieving the center distance 33 between the motor shaft 18 and the throttle shaft 9 with a high degree of accuracy. Consequently, it becomes possible to maintain satisfactory meshing accuracy between the throttle gear 12 and the pinion gear 19 attached onto the respective shafts.

In addition, it is only necessary to finish a limited region, that is, the positioning recess 25 and projection 23 provided on one sides of the drive motor 5 and the throttle body 2, respectively, with a high degree of accuracy. Hence, unlike the air-intake control apparatus in the related art in which the drive motor 5 is attached by insertion or press-fitting, highly accurate dimension settings are not required in a wide range. It is possible to considerably shorten time required for processing. Hence, dimensions can be controlled easily.

Displacement of the motor shaft 18 in a direction perpendicular to a center-to-center direction between the drive motor 5 and the throttle shaft 9 has little influence on variations of the center distance 33. Hence, a certain amount of clearance can be provided to fitting of the positioning recess 25 and protrusion 23. Accordingly, by setting a width B (for example, 18 mm) of the positioning recess 25 of the drive motor 5 greater than a width A (for example, 16 mm) of the positioning projection 23 of the throttle body 2, and by providing taper portions 34 at the both ends of the respective positioning recess 25 and projection 23, even when the drive motor 5 undergoes displacement in a direction perpendicular to the center-to-center direction when the drive motor 5 is pressed from sideways by the attachment jig 32 to allow the positioning recess 25 and projection 23 of the drive motor 5 and the throttle body 2, respectively, to abut on each other, the position is corrected by the taper portions 34. Attachment can therefore become easy.

Also, by providing the positioning recess 25 and projection 23 on the side located between the throttle shaft 9 and the drive motor 5, and by setting dimensions of the respective components so that a top clearance of the gear becomes greater than 0 even when dimensional variations occur in the respective components, it becomes possible to eliminate a risk that the throttle valve 3 becomes inoperable due to poor meshing of the gears (interference at tooth tips or tooth bases of the gears caused by a top clearance reducing to 0 or less) even when the apparatus is formed of components all of which have maximum tolerance dimensions or when the drive motor 5 undergoes displacement because the fastening screws 27 of the drive motor 5 become loose for some reason.

Further, the blade spring 26 (for example, a corrugated washer) is provided at the back end of the drive motor 5 and three or more fastening screws 27 are used. Hence, of the three fastening screws 27, by first tightening the fastening screw 27 close to the positioning recess 25 and projection 23, a reactive force of the blade spring 26 acts in a direction in which the drive motor 5 is moved toward where the positioning recess 25 and protrusion 23 are present. Hence, it becomes possible to allow the positioning recess 25 and the projection 23 of the drive motor 5 and the throttle body 2, respectively, to abut on each other without having to use the attachment jig 32 used to press the drive motor 5 from sideways. Consequently, it becomes possible to further enhance attachment workability of the drive motor 5.

Second Embodiment

Figure 5:
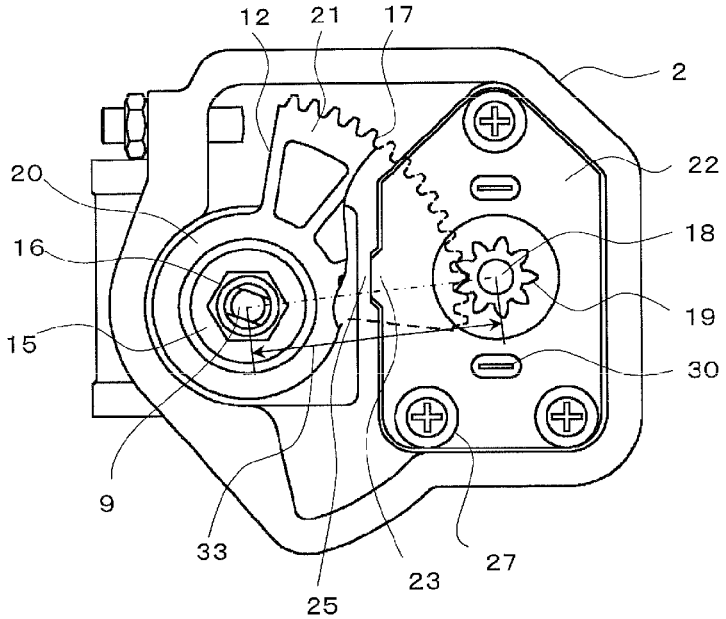
FIG. 5 is a side view of an air-intake control apparatus of an internal combustion engine according to a second embodiment of the invention on a side of a drive portion in a state where a cover is removed.

FIG. 5 is a side view of an air-intake control apparatus according to a second embodiment of the invention on a side of a drive portion in a state where a cover is removed.

Referring to FIG. 5, as in the first embodiment above, the drive motor 5 and the throttle body 2 are provided with the positioning recess 25 and projection 23. It should be noted, however, that the drive motor 5 is provide with the positioning projection 23 whereas the throttle body 2 is provided with the positioning recess 25. In short, the locations of the positioning recess 25 and projection 23 are reversed from the locations of the first embodiment above.

In this manner, it can be set arbitrarily as to which of the positioning recess 25 and projection 23 is provided to which of the drive motor 5 and the throttle body 2. It is therefore possible to dispose the positioning recess 25 and projection 23 without any limitation depending on a layout of the product.

Third Embodiment

Figure 6:
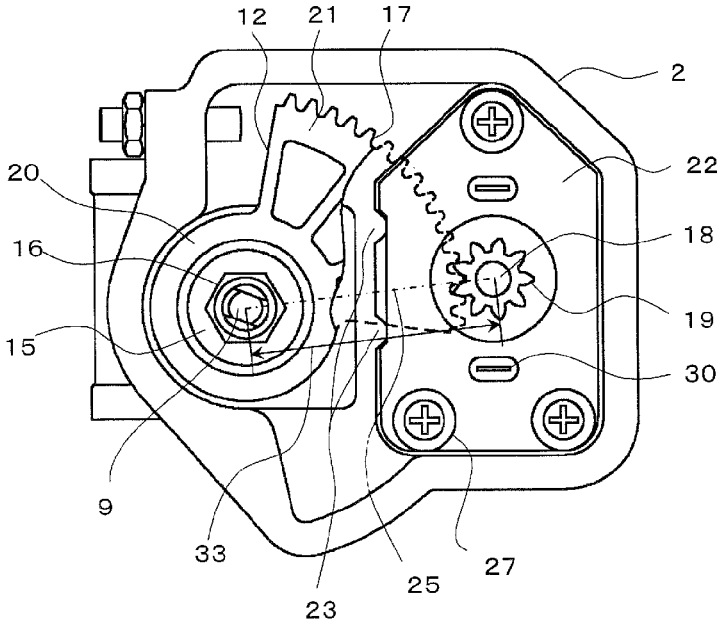
FIG. 6 is a side view of an air-intake control apparatus of an internal combustion engine according to a third embodiment of the invention on a side of a drive portion in a state where a cover is removed.
Figure 7:
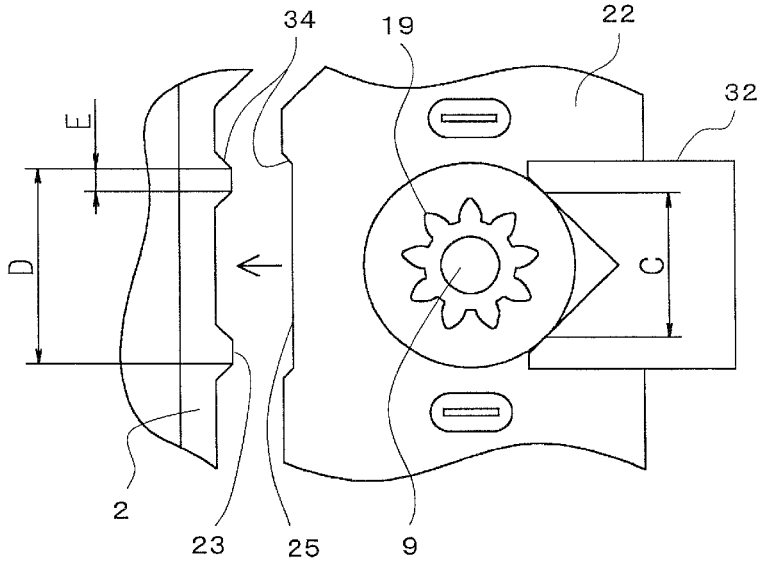
FIG. 7 is a view used to describe a state of positioning projections and recess of a throttle body and a drive motor, respectively, and an attachment jig in the third embodiment.
Figure 8:
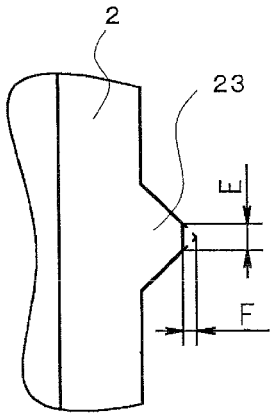
FIG. 8 is a view used to describe a processing margin of the positioning projection of the throttle body in the third embodiment.

FIG. 6 is a side view of an air-intake control apparatus according to a third embodiment of the invention on a side of a drive portion in a state where the cover 7 is removed. FIG. 7 is a view used to describe a state of positioning projections and recess of the throttle body 2 and the drive motor 5, respectively, and an attachment jig. FIG. 8 is a view used to describe a processing margin F of the positioning projection of the throttle body 2 in the third embodiment.

According to the air-intake control apparatus of the third embodiment, the positioning projection 23 (or the recess portion, and the same applies in the following) is provided to the throttle body 2 at two points and a width D (for example, 16 mm) between end points of the positioning projections 23 at two points is set to be equal to or greater than a width C (for example, 13 mm) of the drive motor 5 in a portion pressed by the attachment jig 32 when the drive motor 5 is attached to the throttle body 2. When configured in this manner, it becomes possible to suppress an inclination of the drive motor 5 at the positioning projections 23 when pressed by the attachment jig 32. Hence, the drive motor 5 can be attached to the throttle body 2 while achieving the center distance 33 with a further higher degree of accuracy. Consequently, it becomes possible to maintain satisfactory meshing accuracy between the throttle gear 12 and the pinion gear 19 attached onto the respective shafts.

Also, a width E of the respective projections 23 of the throttle body 2 requires post-processing by cutting or the like in order to achieve the center distance 33 with accuracy. Herein, assume that 0.5 mm is given as a processing margin F when an aluminum die cast is subjected to post-processing and the taper portions 34 are provided to the respective positioning projections 23 at 45°. Then, by setting the width E of the positioning projections 23 to 1 mm or greater, it becomes possible to form the positioning projections 23 by minimum necessary processing while ensuring a stable processing margin F (see FIG. 8).

Also, as has been described, it is necessary to set the width D between the end points of the positioning projections 23 at two points to be equal to or greater than the width C of the drive motor 5 in a portion pressed by the attachment jig 32 when the drive motor 5 is attached to the throttle body 2. However, by setting a sum of the widths of the positioning projections 23 at two points to 50% or less of the width in a case where the positioning projection 23 is provided at one point, it becomes possible to make a processing time shorter, a life of processing tools longer, and a range of dimensional control narrower further by 50% or more.

Further, by providing the positioning projections 23 at two points of the throttle body 2 and disposing the positioning projections 23 symmetrically with respect to the motor shaft 18, when the drive motor 5 is pressed from sideways with the attachment tool 32, a pressing load is dispersed homogeneously in the protrusions 23 at two points. Hence, it becomes possible to suppress an inclination of the drive motor 5 at the positioning projections 23 and it becomes possible to attach the drive motor 5 to the throttle body 2 with a high degree of accuracy.

Fourth Embodiment

Figure 9:
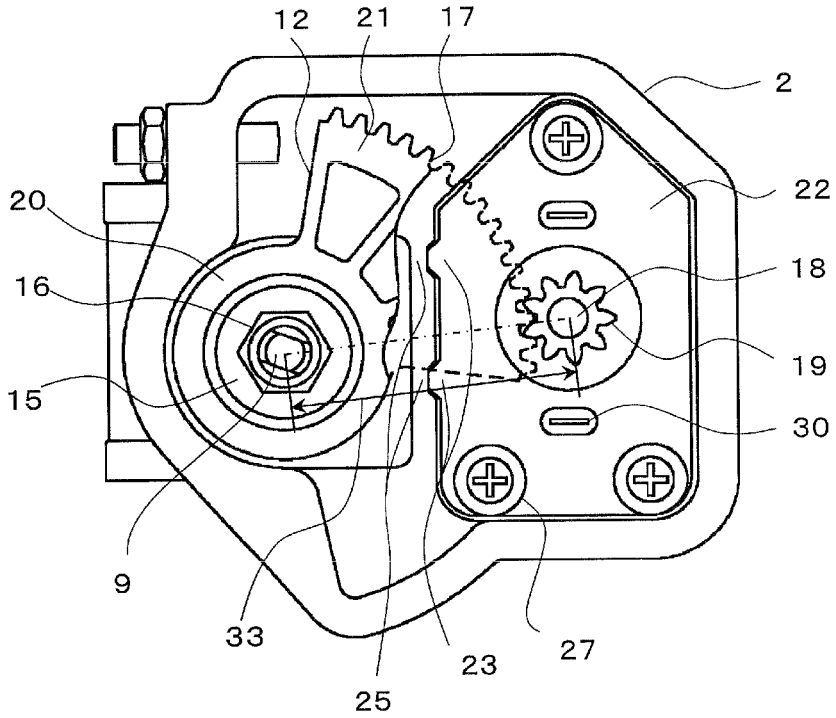
FIG. 9 is a side view of an air-intake control apparatus of an internal combustion engine according to a fourth embodiment of the invention on a side of a drive portion in a state where a cover is removed.

FIG. 9 is a side view of an air-intake control apparatus according to a fourth embodiment of the invention on a side of the drive portion in a state where the cover 7 is removed.

The third embodiment above has described a case where the positioning projections 23 are provided to the throttle body 2 at two points. It should be appreciated, however, that the same advantage can be achieved even in a reverse case where, as is shown in FIG. 9, the positioning recess 25 of the flange portion 22 is replaced with a projection and the positioning projection 23 is provided to the flange portion 22 at two points.

It should be appreciated that applications of the invention are not limited to the air-intake control apparatus, and the invention is also applicable to various actuators using a drive motor.

Various modifications and alterations of this invention will be apparent to those skilled in the art without departing from the scope and spirit of this invention, and it should be understood that this is not limited to the illustrative embodiments set forth herein.

What is claimed is:

1. An air-intake control apparatus of an internal combustion engine, comprising:

a throttle body defining an air intake channel for an internal combustion engine and having within a throttle shaft supported in a rotatable manner, a throttle gear attached to the throttle shaft, and a motor shaft provided with a pinion gear meshed with the throttle gear, and in which a drive motor that turns the throttle shaft to an arbitrary angle via the pinion gear and the throttle gear is stored, wherein:

the drive motor is housed in a cylindrical hole portion provided to the throttle body;

a flange portion provided to an end portion of the drive motor is attached to the cylindrical hole portion;

the throttle body has one of at least one positioning projection and at least one positioning recess provided to only a part at a side positioned between the throttle shaft and the drive motor, of an inner wall of the cylindrical hole portion;

the drive motor complementarily has one of at least one positioning recess and at least one positioning projection provided to the flange portion only at a position corresponding to one of the positioning projection and recess; and the one of the positioning projection and recess and the one of the positioning recess and projection are in such a relationship that sets a center distance between the motor shaft and the throttle shaft to a predetermined value while the one of the positioning projection and recess abuts on the one of the positioning recess and projection complementarily.

2. The air-intake control apparatus of an internal combustion engine according to claim 1, wherein:

a width of one of the positioning recess and projection of the flange portion is greater than a width of one of the complementary positioning projection and recess of the cylindrical hole portion; and taper portions are provided at both ends of one or both of one of the positioning recess and projection of the flange portion and one of the complementary positioning projection and recess of the cylindrical hole portion.

3. The air-intake control apparatus of an internal combustion engine according to claim 1, wherein:

a blade spring that presses the drive motor in a direction in which one of the positioning recess and protrusion and one of the complementary positioning projection and recess abut on each other is provided between a bottom portion of the drive motor and a bottom portion of the cylindrical hole portion; and the drive motor is attached to the throttle body with three or more screws.

4. The air-intake control apparatus of an internal combustion engine according to claim 1, wherein:

the positioning projection is provided to the cylindrical hole portion at two points for the positioning recess of the flange portion; and a width between end points of the positioning projections at the two points is set to be equal to or greater than a width of the drive motor in a portion pressed by an attachment jig.

5. The air-intake control apparatus of an internal combustion engine according to claim 4, wherein:

the positioning projections of the cylindrical hole portion are disposed symmetrical with respect to the motor shaft.

6. The air-intake control apparatus of an internal combustion engine according to claim 1, wherein:

the positioning projection is provided to the flange portion at two points for the positioning recess of the cylindrical hole portion; and a width between end points of the positioning projections at the two points is set to be equal to or greater than a width of the drive motor in a portion pressed by an attachment jig.

7. The air-intake control apparatus of an internal combustion engine according to claim 6, wherein:

the positioning projections of the flange portion are disposed symmetrical with respect to the motor shaft.

* * * * *